US012103646B2

(12) United States Patent
Wahlgren

(10) Patent No.: US 12,103,646 B2
(45) Date of Patent: Oct. 1, 2024

(54) MODULAR BARGE

(71) Applicant: Eddy Pump Corporation, El Cajon, CA (US)

(72) Inventor: Daniel Wahlgren, Escondido, CA (US)

(73) Assignee: EDDY PUMP CORPORATION, El Cajon, CA (US)

( * ) Notice: Subject to any disclaimer, the term of this patent is extended or adjusted under 35 U.S.C. 154(b) by 365 days.

(21) Appl. No.: 17/501,117

(22) Filed: Oct. 14, 2021

(65) Prior Publication Data

US 2023/0124623 A1 Apr. 20, 2023

(51) Int. Cl.

| | |
|---|---|
| ***B63B 35/28*** | (2006.01) |
| ***B63B 3/08*** | (2006.01) |
| ***B63B 35/34*** | (2006.01) |
| ***B63B 35/38*** | (2006.01) |

(52) U.S. Cl.

CPC ..... *B63B 35/28* (2013.01); *B63B 3/08* (2013.01); *B63B 35/34* (2013.01); *B63B 35/38* (2013.01)

(58) Field of Classification Search

CPC ..... B63B 3/08; B63B 2003/085; B63B 35/28; B63B 35/34; B63B 35/38; B65D 88/121; B65D 90/0006; B65D 90/0013; B65D 90/002; B65D 90/0026; E01D 15/14; E01D 15/145

See application file for complete search history.

(56) References Cited

U.S. PATENT DOCUMENTS

| | | | | |
|---|---|---|---|---|
| 812,911 | A | 2/1906 | Wyman et al. | |
| 3,057,315 | A | 10/1962 | Robishaw | |
| 3,805,721 | A * | 4/1974 | Robishaw | B63B 35/38 114/77 R |
| 4,431,368 | A * | 2/1984 | Katz | B60P 1/6481 280/DIG. 8 |
| 4,714,042 | A * | 12/1987 | Schulte | B63B 35/38 114/77 R |
| 4,809,636 | A * | 3/1989 | Robishaw | B63B 35/38 114/267 |
| 8,353,417 | B1 * | 1/2013 | Wu | B65D 45/20 220/23.6 |

FOREIGN PATENT DOCUMENTS

| | | | | |
|---|---|---|---|---|
| DE | 10020513 | A1 * | 10/2001 | B63B 3/08 |
| DE | 10021806 | A1 * | 11/2001 | B63B 35/38 |
| EP | 2213567 | A2 * | 8/2010 | B63B 35/38 |
| KR | 102022805 | B1 | 9/2019 | |

OTHER PUBLICATIONS

International Search Report and Written Opinion issued Jan. 27, 2023 in corresponding International Application No. PCT/US22/46556.

* cited by examiner

*Primary Examiner* — Ajay Vasudeva
(74) *Attorney, Agent, or Firm* — GLOBAL IP COUNSELORS, LLP

(57) ABSTRACT

A modular barge includes a first barge section and a section barge section. The first barge section is buoyant in water, and includes a first locking mechanism. The second barge section is buoyant in water, and includes a second locking mechanism. The first locking mechanism is attached to the first barge and includes a protrusion configured to couple to the second locking mechanism.

16 Claims, 6 Drawing Sheets

MODULAR BARGE

BACKGROUND

Field of the Invention

The present invention generally relates to a modular barge. More specifically, the present invention relates to a modular barge that can be easily and quickly assembled.

Background Information

Conventional barges are generally flat-bottomed boats built mainly for transport of bulk goods or other devices. Conventional modular barges enable the connection of a plurality of barge sections together to form a single larger barge. Some conventional modular barge systems can form building blocks for all sorts of modular pontoons and vessels. These modular barge systems enable the barges to be formed in different configurations that can enable transportation of a large range of equipment or goods.

SUMMARY

It has been discovered that an improved modular barge is desired. In particular, it has been determined that an easy, cost efficient method of coupling the modular sections of a modular barge system is desired. Moreover, it has been determined that a structure that can be more easily shipped and operated is desired.

In view of the state of the known technology, one aspect of the present disclosure is to provide a modular barge, comprising a first barge section and a second barge section. The first barge section is configured to be buoyant in water, and includes a first locking mechanism, the first locking mechanism configured to be removably attached to the first barge section. The second barge section is configured to be buoyant in water, and includes a second locking mechanism, the second locking mechanism configured to be attached to the second barge section and including a protrusion configured to couple to the first locking mechanism.

In a second aspect of the modular barge according to the first aspect, the modular barge further comprises a locking bar configured to be moved in a vertical direction to cause the second locking mechanism to engage the first locking mechanism.

In a third aspect of the modular barge according to the first or second aspect, the second locking mechanism is a one of a plurality of second locking mechanisms on the second barge section.

In a fourth aspect of the modular barge according to the any of the previous aspects, the locking bar is configured to simultaneously engage each of the plurality of second locking mechanisms to cause the second locking mechanisms to move to a locked state.

In a fifth aspect of the modular barge according to the any of the previous aspects, the plurality of second locking mechanisms are disposed in a vertical direction relative to each other.

In a sixth aspect of the modular barge according to the any of the previous aspects, the locking bar has a length, and the second barge section has a height, the height of the second barge section being substantially the same as the height of the locking bar.

In a seventh aspect of the modular barge according to the any of the previous aspects, the locking bar is configured to extend beyond a top surface of the second barge section when the second locking mechanism is in an unlocked state.

In an eighth aspect of the modular barge according to the any of the previous aspects, the protrusion of the second locking mechanism is configured to engage an opening in the first locking mechanism.

In a ninth aspect of the modular barge according to the any of the previous aspects, each of the first barge section and the second barge section includes a skid plate.

A tenth aspect of the present invention is direct to a method of connecting a first barge section of a modular barge with a second barge section of the modular barge. The method comprises disposing the first barge section in water, the first barge section being buoyant in the water, and including a first locking mechanism, the first locking mechanism configured to be removably attached to the first barge section, disposing the second barge section in the water, the second barge section configured to be buoyant in the water, and including a second locking mechanism attached to the second barge and including a protrusion, moving the first barge section adjacent the second barge section, and locking the second locking mechanism to the first locking mechanism by coupling the protrusion to the first locking mechanism.

In an eleventh aspect of the method according to the any of the previous aspects, the method further comprises moving a locking a vertical direction to cause the second locking mechanism to engage the first locking mechanism.

In a twelfth aspect of the method according to the any of the previous aspects, the second locking mechanism is a one of a plurality of second locking mechanisms on the second barge section.

In a thirteenth aspect of the method according to the any of the previous aspects, the locking bar simultaneously engages each of the plurality of second locking mechanisms causing the second locking mechanisms to move to a locked state.

In a fourteenth aspect of the method according to the any of the previous aspects, the plurality of second locking mechanisms are disposed in a vertical direction relative to each other.

In a fifteenth aspect of the method according to the any of the previous aspects, the locking bar has a length, and the second barge section has a height, the height of the second barge section being substantially the same as the height of the locking bar.

In a sixteenth aspect of the method according to the any of the previous aspects, the locking bar extends beyond a top surface of the second barge section when the second locking mechanism is in an unlocked state.

In a seventeenth aspect of the method according to the any of the previous aspects, the locking the second locking mechanism to the first locking mechanism includes engaging the protrusion of the second locking mechanism with an opening in the first locking mechanism.

In an eighteenth aspect of the method according to the any of the previous aspects, each of the first barge section and the second barge section includes a skid plate.

The embodiments of the present disclosure describe an improved modular barge. In particular, the improved modular barge described herein includes modular sections that easy and cost efficient to couple together to form a modular barge system. Moreover, the improved modular barge described herein includes a structure that can be more easily shipped and operated.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
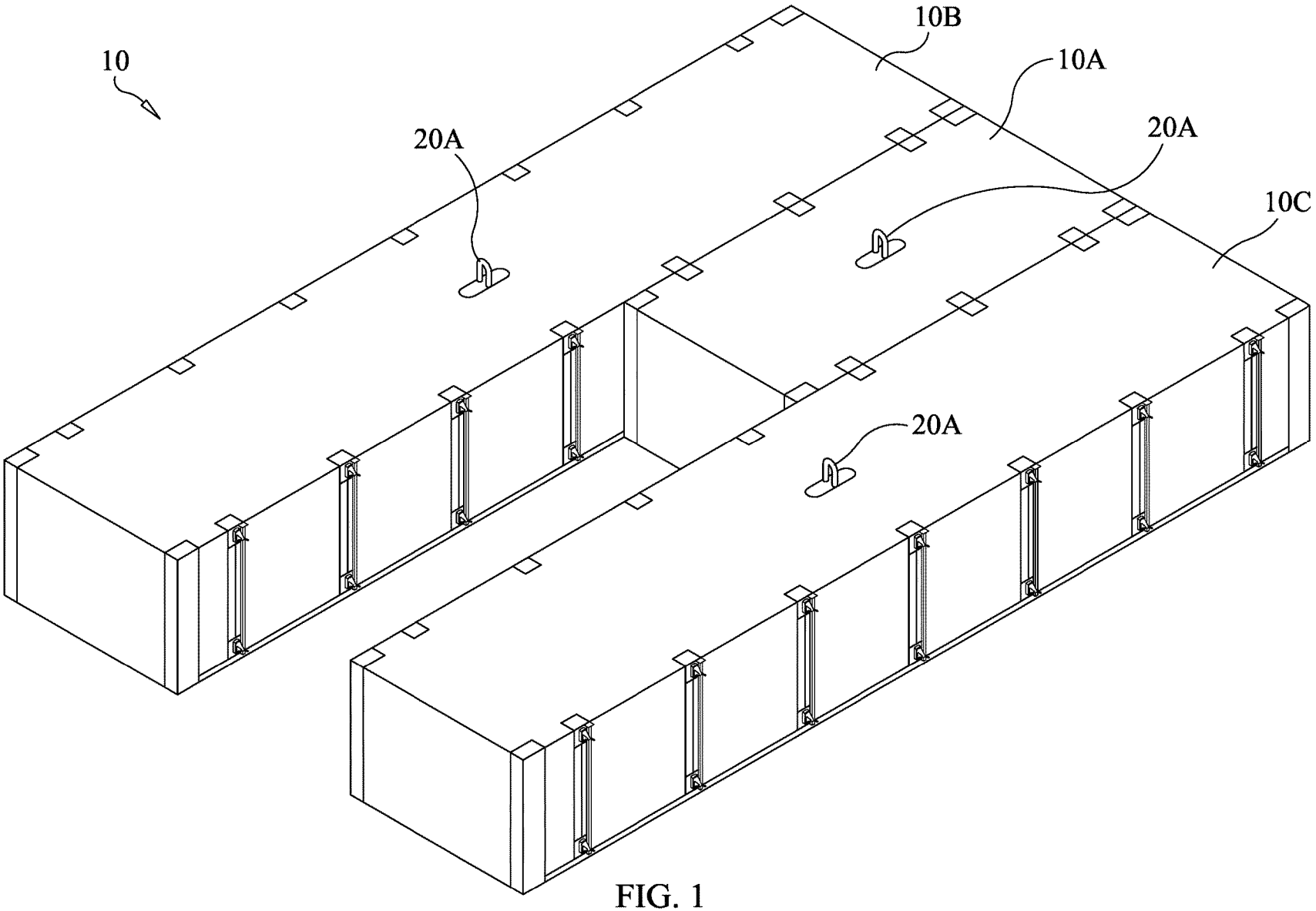
FIG. 1 is a top perspective view of a modular barge according to an embodiment of the present invention.
Figure 2:
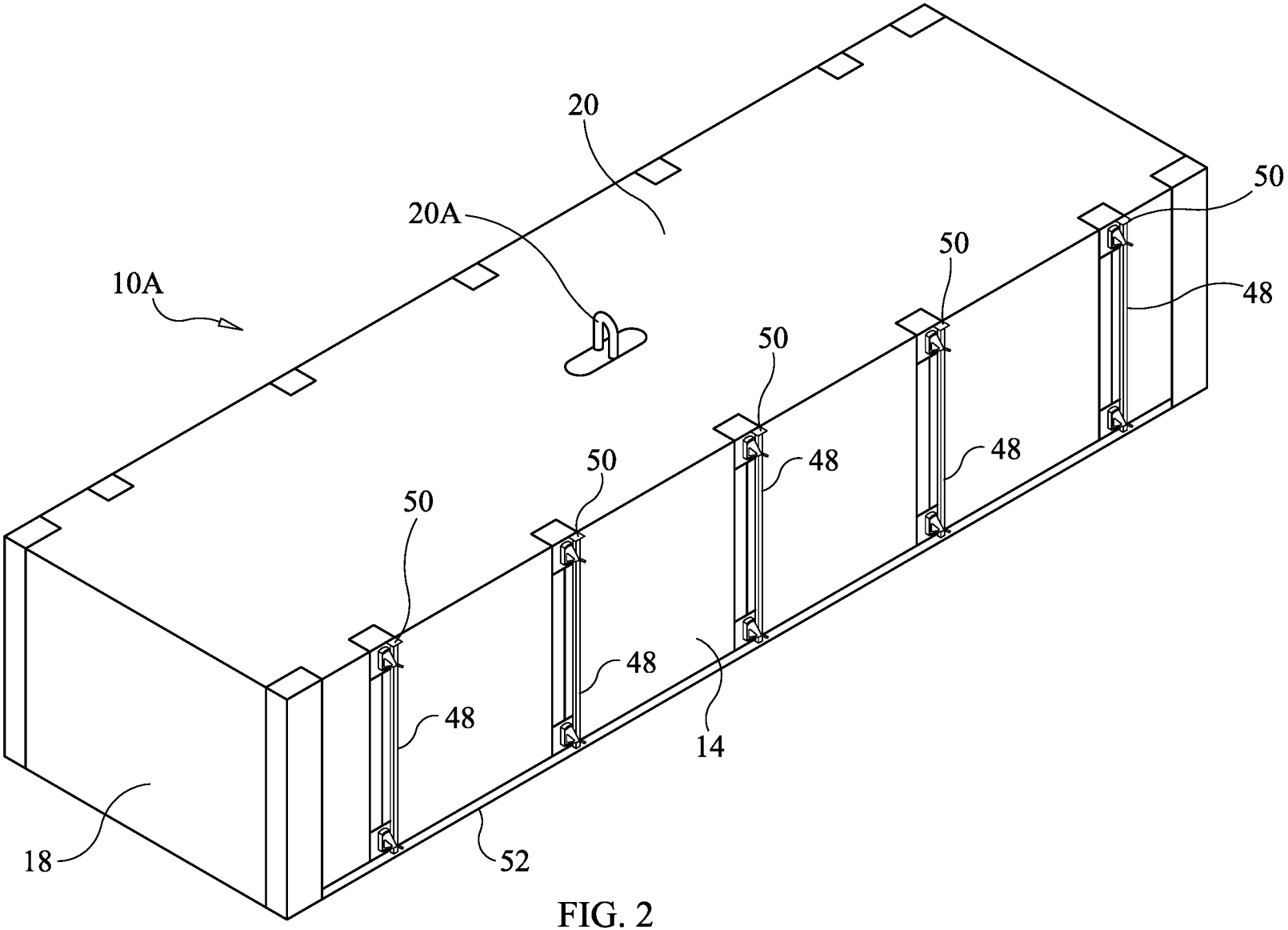
FIG. 2 is a top perspective view of a modular barge section from the modular barge of FIG. 1.
Figure 3:
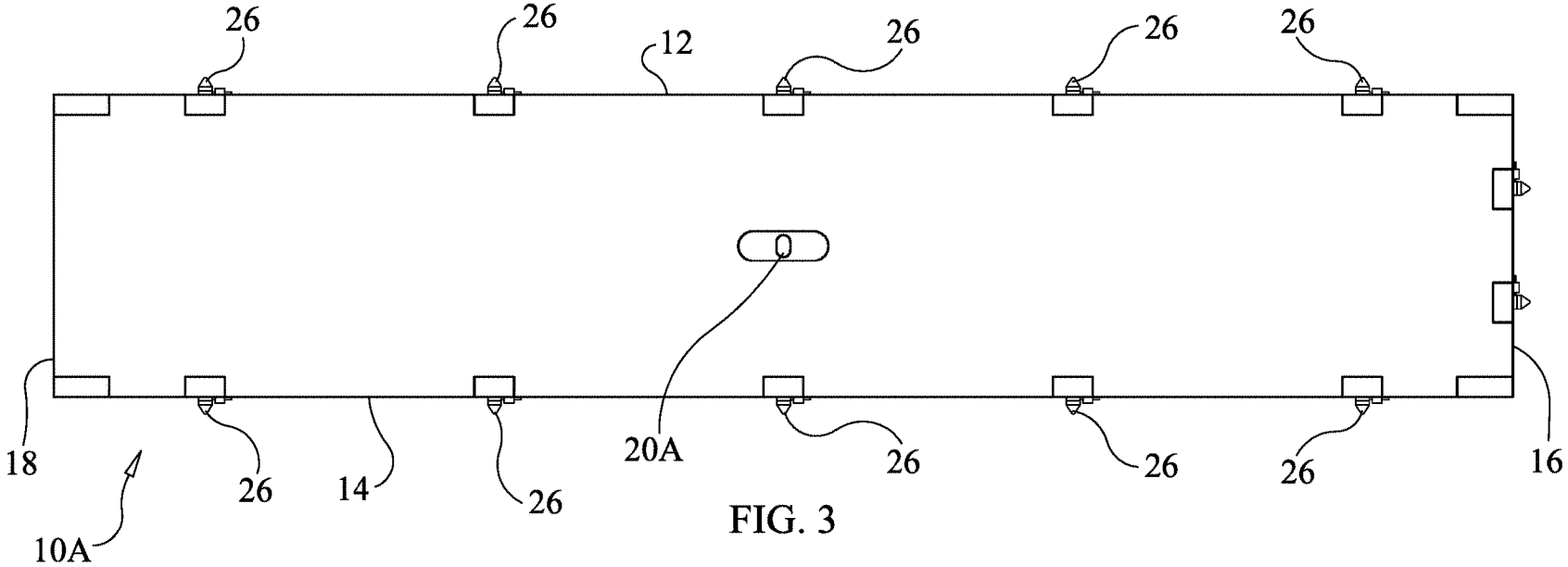
FIG. 3 is a top view of the modular barge section of FIG. 2.
Figure 4:
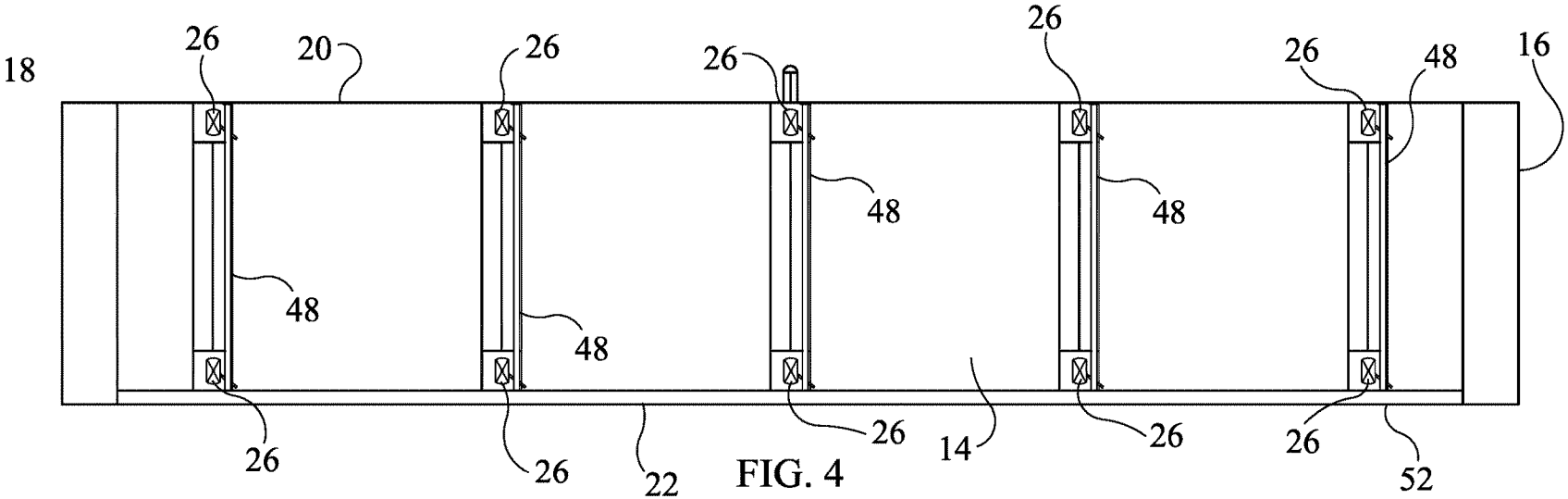
FIG. 4 is a side elevational view of the modular barge section of FIG. 2.

Referring initially to FIG. 1, a modular barge 10 is illustrated in accordance with a first embodiment. In this embodiment, the modular barge 10 includes a plurality of barge sections (10A, 10B and 10C). For example, the modular barge 10 can include a first barge section 10A and a second barge section 10B. As can be understood, both the first barge section 10A and the second barge section 10B are buoyant in a fluid such as water. The water can be fresh water, salt water and/or brackish water.

As shown in FIGS. 1-6, the barge sections 10A, 10B and 10C can be formed from steel or any other suitable material or metal. The barge sections 10A, 10B and 10C are generally rectangular with first and second sides 12 and 14, first and second ends 16 and 18, a top 20 and a bottom 22. Each of the sides 12 and 14, ends 16 and 18, top 20 and bottom 22 can be welded together to form water tight barge section. The top 20 can include an attachment device 20A, such as a metal loop such that a crane or other device can lift the barge sections 10A, 10B and 10C.

As can be understood, each barge section 10A, 10B and 10C displaces water such that at least a portion of the barge section 10A, 10B and 10C will be above water when disposed in water. However, it is noted that the barge sections 10A, 10B and 10C can be formed in any manner suitable so as to be water tight when in use. In one embodiment, each barge section 10A, 10B and 10C is sealed (e.g., welded) so as to be water tight to prohibit or limit access to the interior. However, in one embodiment, there can be access panels, doors (not shown) or another manner to access or use the interior of the barge sections 10A, 10B and 10C when not being used as floating barge section.

The first and second barge sections 10A and 10B can be about 20 feet and length or about 40 feet in length. Thus, the modular barge 10 can be comprised of differing barge sections 10A, 10B and 10C lengths, if desired. Preferably, each of the barge sections 10A, 10B and 10C has a standard height and width. For example, the height can be about 4 feet and 2.5 inches and the width can be about 7 feet and $10\frac{31}{32}$ inches. As can be understood, in one embodiment, the width and the length of the barge sections 10A, 10B and 10C are designed so as to have the same dimensions as a standard 20 foot or 40 foot ISO shipping container. That is, a standard 20 foot ISO shipping container is 19 feet and $10\frac{29}{32}$ inches in length and 7 feet and $10\frac{31}{32}$ inches in width and a standard 40 foot ISO shipping container is 39 feet and $11\frac{7}{8}$ inches in length and 7 feet and $10\frac{31}{32}$ inches in width. However, it is noted that these dimensions are exemplary and the barge sections 10A, 10B and 10C can have any suitable or desired dimensions, and/or shape and/or configuration.

The barge sections 10A, 10B and 10C can include a plurality of locking systems 24 that enable the two barge sections 10A, 10B and 10C (e.g., the first barge section 10A and the second barge section 10B) to be locked together. In one embodiment, the first barge section 10A includes a first locking mechanism 26 of the locking system 24 and the second barge section 10B includes a second locking mechanism 28 of the locking system. The second locking mechanism 28 is configured to couple to the first locking mechanism 26.

As can be understood, the barge sections 10A, 10B and 10C need to be secured properly to ensure there is no separation of the sections during use. One embodiment of the locking system 24 to secure the barge sections 10A, 10B and 10C is a twist lock. The twist lock includes the first locking mechanism 26 on the first barge and the second locking mechanism 28 on the second barge, as shown in Figures, as shown in FIGS. 7-13.

In this embodiment, the first locking mechanism 26 is casted steel structure that can be galvanized. The first locking mechanism 26 includes a base structure 30, a rotating structure 32 and a handle 35. The base structure 30 is preferably a casted steel housing structure that includes a through passage way for the rotating structure 32 and a slot 33 for the handle 35. The rotating structure 32 includes a first protrusion 34 on a first end 36 and a second protrusion 38 on a second end 40. As will be discussed below the protrusions 32 and 38 can have a tapered or chamfered configuration. The protrusions 32 and 38 are connected by a rotating member or bar (not shown) that passes through the base structure 30. The handle 35 is connected to the rotating structure 32 and extends outwardly from the base structure 30 through the slot 33. The handle 35 enables the rotating member to be rotated relative to the base structure 30.

Figure 10:
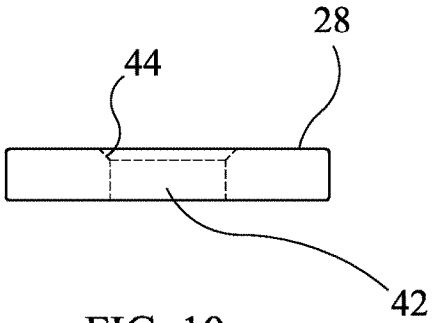
FIG. 10 is a side elevational view of the locking mechanism of FIG. 9.
Figure 7:
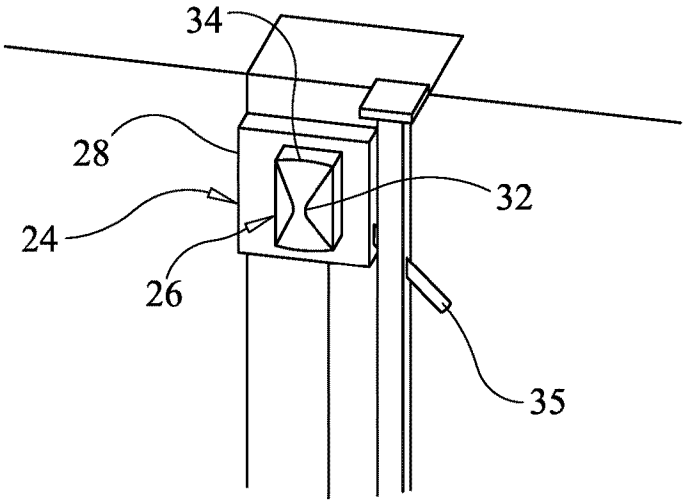
FIG. 7 illustrates the locking mechanism for locking the modular barge sections in a locked position and disposed on a modular barge section.
Figure 9:
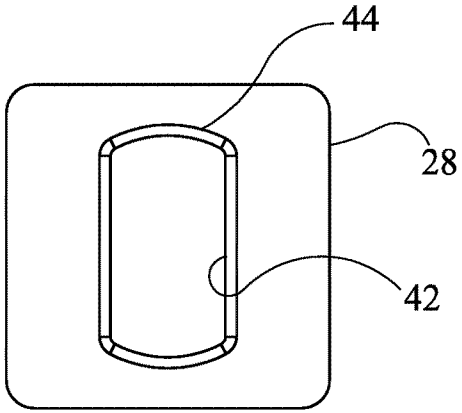
FIG. 9 illustrates a locking mechanism to which the locking mechanism in FIG. 8 is configured to couple.
Figure 11:
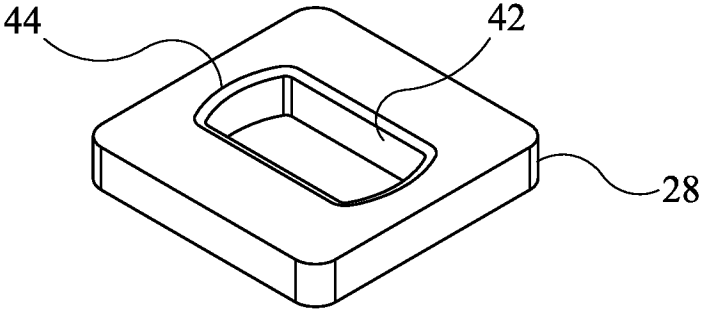
FIG. 11 is a top perspective view of the locking mechanism of FIG. 9.

The second locking mechanism 28 is preferably a container fitting. That is as is illustrated in FIGS. 9-11, the second locking mechanism 28 is a plate having an opening 42 therein. This plate is connected to the barge section in any manner desired, such as welding. However, it is noted that the second locking mechanism 28 can be permanently or removably attached to the second barge section 10B. The opening is generally rectangular and has a chamfered edge 44; however, the opening 42 can have any suitable configuration.

One example of a twist lock is the Shipping Container Manual Twist Lock (Left/Right Hand Locking). This twist lock has a hot dip galvanized surface treatment, and has a minimum breaking load tension of about 500 KN, a minimum breaking load shear of about 420 KN, and a minimum breaking load compression of about 2000 KN. This manual twist-lock can be locked and unlocked easily by hand. It doesn't require a lever or any specialized gear to use effectively. This ease of use is ideal for any quick adjustments that must be made. Moreover, the twist lock can keep the barge sections containers secure, and can be used to secure two barge sections together in order to stack them or stabilize them if the barge sections are being shipped. In one embodiment, this twist lock is cast as a single, solid unit in high-quality steel.

Figure 5:
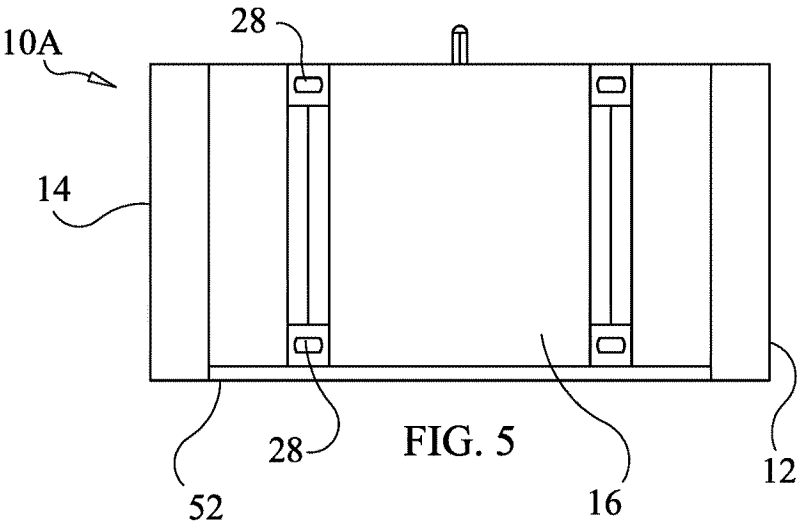
FIG. 5 is an end view of the modular barge section of FIG. 2.
Figure 6:
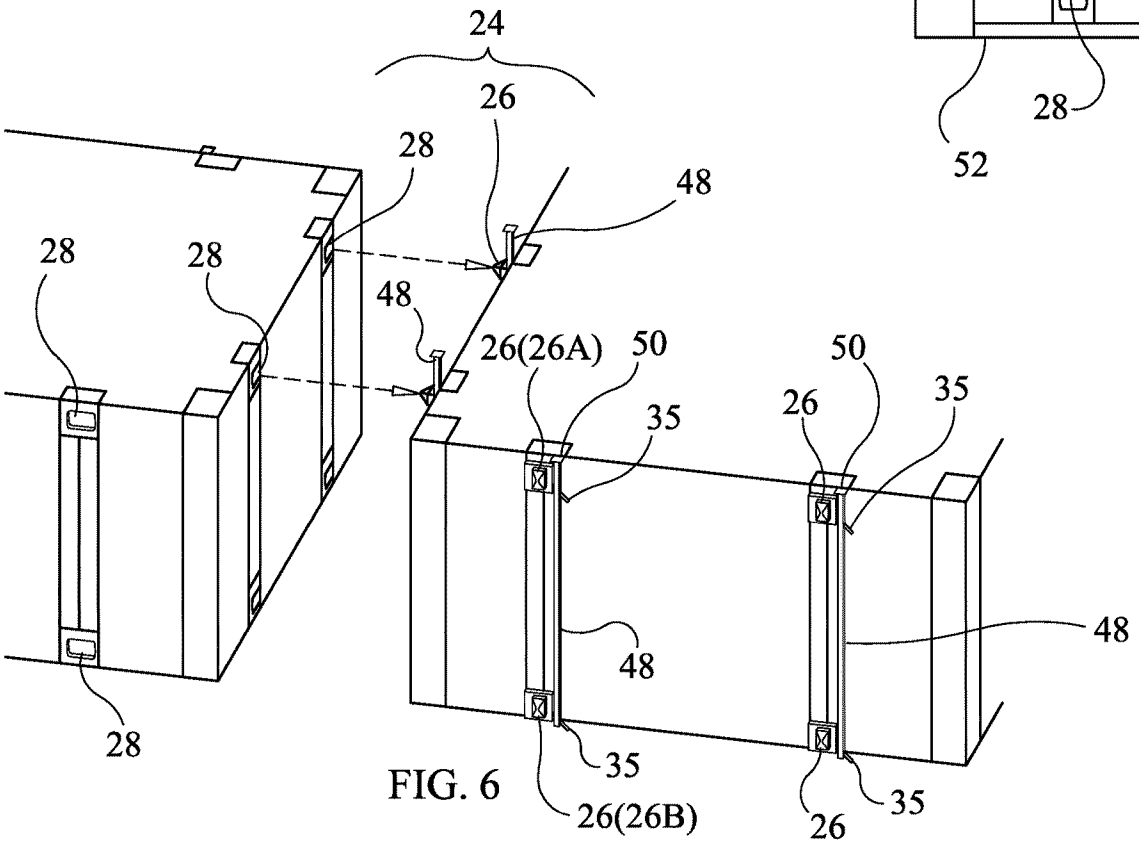
FIG. 6 is a top perspective view of two modular barge sections of a modular barge being connected together.
Figure 8:
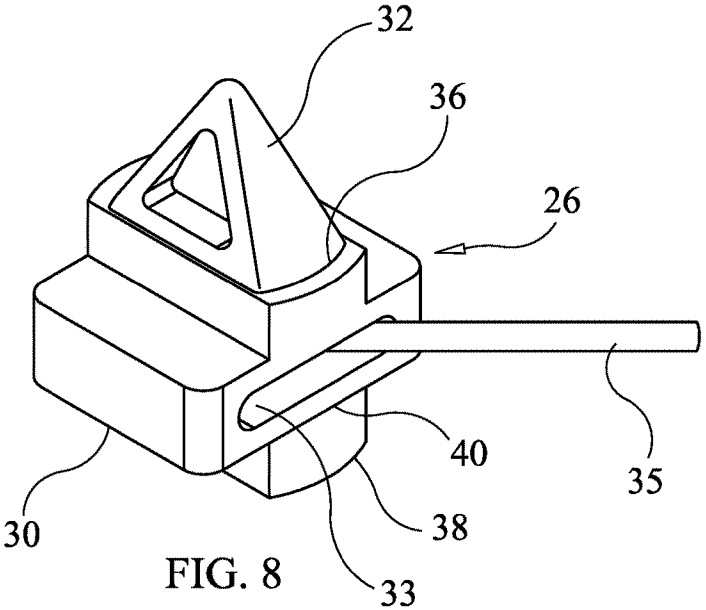
FIG. 8 illustrates the locking mechanism for locking the modular barge sections in an unlocked position.

As illustrated in FIGS. 2-6, a plurality of first locking mechanisms 26 are coupled to the section barge section adjacent the top 20 and the bottom 22. Preferably, the first locking mechanisms 26 are disposed along the first and second sides 12 and 14 and the first and second ends 16 and 18. Moreover, generally a pair of first locking mechanisms 26 are disposed so as to align in a vertical direction. That is, as illustrated in FIG. 6, for example, each first locking mechanism 26 adjacent the top surface 20 (upper first locking mechanism 26A) is aligned with a respective first locking mechanism 26 adjacent the bottom surface 22 (lower first locking mechanism 26B).

As can be understood, the first locking mechanisms 26 can be permanently or removably attached to the first barge section 10A. That is, the first locking mechanisms 26 can be directly welded at the desired position so as to be permanent, or the first locking mechanisms 26 can attach to a container style fitting as is known in the art of twist locks.

In one embodiment, a locking bar 48 is attached the upper first locking mechanism 26A and the lower first locking mechanism 26B. In one embodiment, the locking bar 48 is attached to the handle 35 of each of the upper and lower first locking mechanisms 26A and 26B. In one embodiment, the locking bar 48 can be attached to the handle 35 of each of the upper and lower first locking mechanisms 26A and 26B in any suitable manner. As can be understood, the locking bar 48 can remain in a vertical position, as the handle 35 of each of the upper and lower first locking mechanisms 26A and 26B rotates from the unlocked to the locked position and/or vice a versa.

Thus, when the locking bar is moved in the vertical direction, the locking bar will simultaneously move or rotate the handle 35 of each of the upper and lower first locking mechanisms 26A and 26B. The locking bar 48 can be a galvanized steel bar that extends approximately the height of the barge section 10A. The locking bar 48 can have a rectangular plate 50 at one or both ends. The rectangular plate 50 encompasses an area that is larger than the cross-sectional area of the locking bar 48.

As illustrated in FIGS. 5 and 6, a plurality of second locking mechanisms 28 are coupled to the section barge section 10B adjacent the top 20 and the bottom 22. Preferably, the second locking mechanisms 28 are disposed along the first and second sides 12 and 14 and the first and second ends 16 and 18. Moreover, generally a pair of second locking mechanisms 28 are disposed so as to align in a vertical direction. That is, each second locking mechanism 28 adjacent the top 20 is aligned with a respective second locking mechanism 28 adjacent the bottom surface 22.

To connect the first and second barge sections 10A and 10B together, the barge sections 10A, 10B and 10C are disposed in water in any manner desired. Since the first and second barge sections 10A and 10B are buoyant in water, these sections will float. As can be understood, depending on the size and configuration of the structure, various heights of the barge sections 10A, 10B and 10C above the water can be obtained. Moreover, as discussed above, the barge sections 10A, 10B and 10C can enable access into the interior of the barge sections 10A, 10B and 10C. Thus, if desired, ballast can be added and/or removed from the barge sections 10A, 10B and 10C to change the water line of the barge sections 10A, 10B and 10C.

The second barge section 10B can be moved relative to the first barge section 10A such that the first barge section 10A is adjacent the second barge section 10B. The barge sections 10A, 10B and 10C can be moved in any manner desired, and can be self-propelled or propelled by an outside device.

In one embodiment, when the first and second barge sections 10A and 10B are near each other, a rope or plurality of ropes can be used to bring the barge sections 10A and 10B immediately adjacent each other. At this time the first locking mechanism 26 on the first barge section 10A can be aligned with the second locking mechanism 28 on the second barge section 10B. preferably, the first locking mechanisms 26 are in an unlocked state. The unlocked state can be seen in FIGS. 2, 4 and 6-8. In the unlocked state, the protrusion 34 is disposed so as to be capable of fitting within the opening 42 in the second locking mechanism 28, the handle 35 for each of the first locking mechanism 26 is disposed in an upward configuration, which causes the locking bar 48 to be in an upward configuration. In this upward configuration, the end of the locking bar 48 extends beyond the top surface of the first barge section 10A.

As the first barge section 10A is brought closer to the second barge section 10B, each of the plurality of protrusions 34 on the first end of the rotating structure 32 of the first locking mechanism 26 enters of the opening in the second locking mechanism 28. Since the protrusions 34 have a chamfered or tapered structure, and the opening 42 includes a chamfered edge 44, the rotating structure can easily slide into the opening 42. The locking bar 48 can then be engaged and moved in a downward direction. This downward direction of the locking bar 48 causes the handle 35 for each of the upper and lower first locking members 26A and 26B to rotate and move in a downward direction, which in turn rotated to the rotating structure 32.

Figure 13:
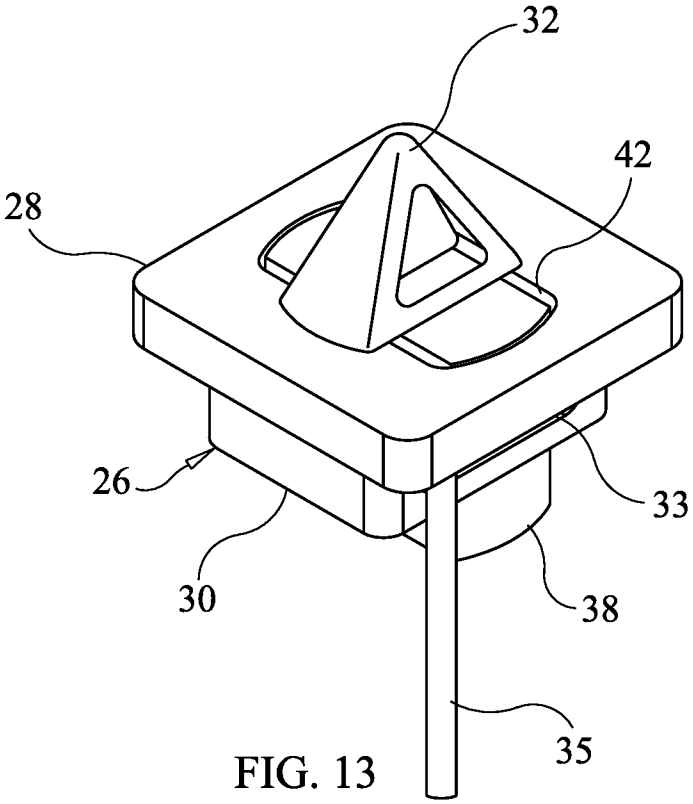
FIG. 13 is a top perspective view of the locking mechanism of FIG. 7 engaging the locking mechanism of FIG. 9 in a locked state.
Figure 12:
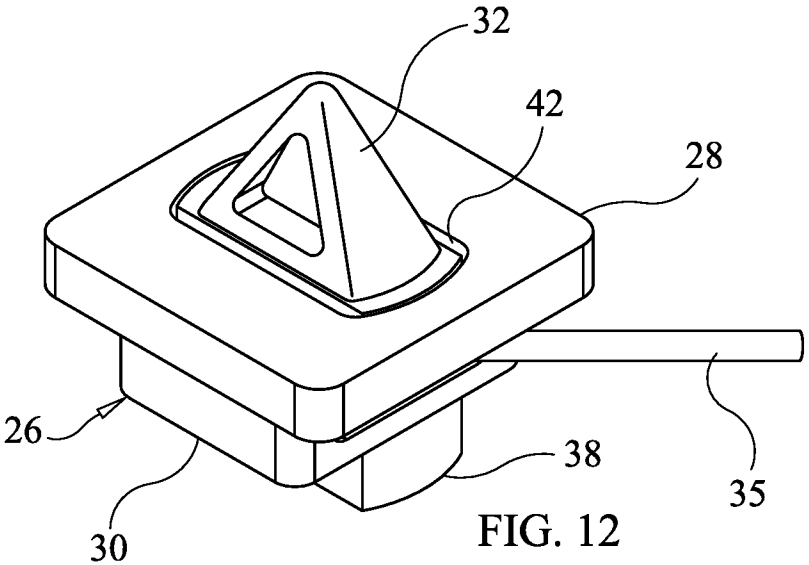
FIG. 12 is a top perspective view of the locking mechanism of FIG. 7 engaging the locking mechanism of FIG. 9 in an unlocked state.

In one embodiment, the first locking member 26 is fixed to the first barge section 10A such that only, the protrusion 34 on the end of the first locking mechanism 26 is rotated and the protrusion 34 about 90 degrees. Since the protrusion 34 on the end of the first locking mechanism 26 is rectangular, the protrusion is locked within the or behind the opening in the second locking mechanism 28. See FIGS. 12 and 13, which illustrate the first locking mechanism 26 disposed within the second locking mechanism 28 in an unlocked state (FIG. 12) and a locked state (FIG. 13).

In another embodiment, as can be understood, the first locking member 26 is coupled to the first barge section 10A with the second protrusion 38. That is, the first barge section 10A includes container fittings (i.e., structures similar to second locking member 28). When the handle 35 of the first locking member 26 is moved partially along slot 33, the second protrusion 38 rotates 90 degrees, locking the first locking member 26 to the first barge section 10A. The first locking member 26 is then locked to the second locking member 28, as described herein.

In one embodiment, the locking bar 48 can be moved in the downward direction by engaging the plate 50 on the end of the locking bar 48 with a foot of a user or in any other manner to easily push the locking bar 48 downward. It is noted that the locking systems 24 are exemplary and the first and second barges 10A and 10B can be coupled together in any suitable manner.

In one embodiment, the barge sections 10A, 10B and 10C include a skid plate 52 for moving the barge sections 10A, 10B and 10C along the ground. The skid plate 52 can protect the bottom 22 of the barge sections 10A, 10B and 10C and aid in moving and/or launching the barge sections 10A, 10B and 10C.

Furthermore, as can be understood, since each of the barge sections 10A, 10B and 10C has the same general shape and size of ISO containers and can include a second locking mechanism 28 that is similar to a container fitting, the barge sections 10A, 10B and 10C can be shipped via semi-trucks or aboard cargo ships.

The embodiments of the present disclosure describe an improved modular barge 10. In particular, the improved modular barge 10 includes modular sections that easy and cost efficient to couple together to form a modular barge 10 system. Moreover, the improved modular barge 10 described herein includes a structure that can be more easily shipped and operated.

The twist locks are conventional components that are well known in the art. Since twist locks are well known in the art, these structures will not be discussed or illustrated in detail herein. Rather, it will be apparent to those skilled in the art from this disclosure that the components can be any type of structure and/or programming that can be used to carry out the present invention.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A modular barge, comprising:

a second barge section configured to be buoyant in water, and including a second locking mechanism, the second locking mechanism configured to be removably attached to the second barge section, the second locking mechanism including an opening;

a first barge section configured to be buoyant in water, and including a first locking mechanism, the first locking mechanism configured to be attached to the first barge section and including a rotating protrusion configured to extend through the opening and rotate to couple the first locking mechanism to the second locking mechanism; and a locking bar configured to be moved in a vertical direction to cause the first locking mechanism to engage the second locking mechanism, the movement of the locking bar in the vertical direction being configured to rotate the rotating protrusion.

2. The modular barge according to claim 1, wherein the first locking mechanism is a one of a plurality of first locking mechanisms on the first barge section.

3. The modular barge according to claim 2, wherein the locking bar is configured to simultaneously engage each of the plurality of first locking mechanisms to cause the first locking mechanisms to move to a locked state.

4. The modular barge according to claim 2, wherein the plurality of first locking mechanisms are disposed in a vertical direction relative to each other.

5. The modular barge according to claim 1, wherein the locking bar has a length, and the first barge section has a height, the length of the locking bar enabling an end of the locking bar to be at substantially the same position as the height of the first barge section when the locking bar is in the second position.

6. The modular barge according to claim 1, wherein the locking bar is configured to extend beyond a top surface of the first barge section when the first locking mechanism is in an unlocked state.

7. The modular barge according to claim 1, wherein each of the first barge section and the second barge section includes a skid plate.

8. The modular barge according to claim 1, wherein the opening in the second locking mechanism has a chamfered edge configured to facilitate coupling the first locking mechanism to the second locking mechanism.

9. A method of connecting a first barge section of a modular barge with a second barge section of the modular barge, the method comprising:

disposing the second barge section in water, the second barge section being buoyant in the water, and including a second locking mechanism, the second locking mechanism configured to be removably attached to the second barge section and having an opening;

disposing the first barge section in the water, the first barge section configured to be buoyant in the water, and including a first locking mechanism attached to the first barge and including a protrusion;

moving the first barge section adjacent the second barge section;

moving the protrusion of the first locking mechanism through the opening in the second locking mechanism; and moving a locking bar in a vertical direction to cause the first locking mechanism to engage the second locking mechanism, the vertical movement of the locking bar locks the first locking mechanism to the second locking mechanism by rotating the protrusion of the first locking mechanism relative to the opening in the second locking mechanism.

10. The modular barge according to claim 9, wherein the first locking mechanism is a one of a plurality of first locking mechanisms on the first barge section.

11. The method according to claim 10, wherein the locking bar simultaneously engages each of the plurality of first locking mechanisms causing the first locking mechanisms to move to a locked state.

12. The method according to claim 10, wherein the plurality of first locking mechanisms are disposed in a vertical direction relative to each other.

13. The method according to claim 9, wherein the locking bar has a length, and the first barge section has a height, the length of the locking bar enabling an end of the locking bar to be at substantially the same position as the height of the first barge section.

14. The method according to claim 9, wherein the locking bar extends beyond a top surface of the first barge section when the first locking mechanism is in an unlocked state.

15. The method according to claim 9, wherein each of the first barge section and the second barge section includes a skid plate.

16. The method according to claim 9, wherein the opening in the second locking mechanism has a chamfered edge to facilitate locking the first locking mechanism to the second locking mechanism.

* * * * *